US005198836A

United States Patent [19]

Saito et al.

[11] Patent Number: 5,198,836

[45] Date of Patent: Mar. 30, 1993

[54] COMPACT LINE THERMAL PRINTER

[75] Inventors: Takeo Saito; Noboru Suzuki; Shuichi Ogawa; Koichi Masuda, all of Tokyo, Japan

[73] Assignee: Seiko Instruments Inc., Japan

[21] Appl. No.: 625,851

[22] Filed: Dec. 11, 1990

[30] Foreign Application Priority Data

| | | | |
|---|---|---|---|
| Dec. 11, 1989 | [JP] | Japan | 1-321861 |
| Dec. 11, 1989 | [JP] | Japan | 1-321862 |
| Dec. 11, 1989 | [JP] | Japan | 1-321863 |
| Dec. 11, 1989 | [JP] | Japan | 1-321864 |
| Dec. 11, 1989 | [JP] | Japan | 1-321865 |
| Dec. 11, 1989 | [JP] | Japan | 1-321867 |

[51] Int. Cl.[5] ..... B41J 2/325

[52] U.S. Cl. ..... 346/76 PH; 400/120; 400/88

[58] Field of Search ..... 400/88, 120, 120 HH; 346/76 PH

[56] References Cited

U.S. PATENT DOCUMENTS 4,750,049 6/1988 Murakami et al. ..... 346/76 PH

*Primary Examiner*—Benjamin R. Fuller
*Assistant Examiner*—Huan Tran
*Attorney, Agent, or Firm*—Bruce L. Adams; Van C. Wilks

[57] ABSTRACT

A line thermal printer is assembled in a pair of side frames opposed to each other a given distance according to a given width size of a printing medium. A guide frame is sandwiched between the pair of side frames for guiding the printing medium. A platen roller unit is disposed detachably between the pair of side frames and is pivotably supported relative to the pair of side frames. A thermal head unit is detachably engaged relative to the pair of side frames in opposed relation to the platen roller unit. A head cover plate is disposed between the pair of side frames to cover the thermal head unit and is placeable in either of an open position and a closed position relative to the pair of side frames. A drive unit is detachably mounted on an outer face of one of the side frames for driving the platen roller.

26 Claims, 8 Drawing Sheets

FIG. 9C
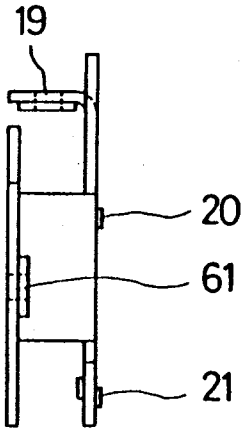
1
FIG. 9A
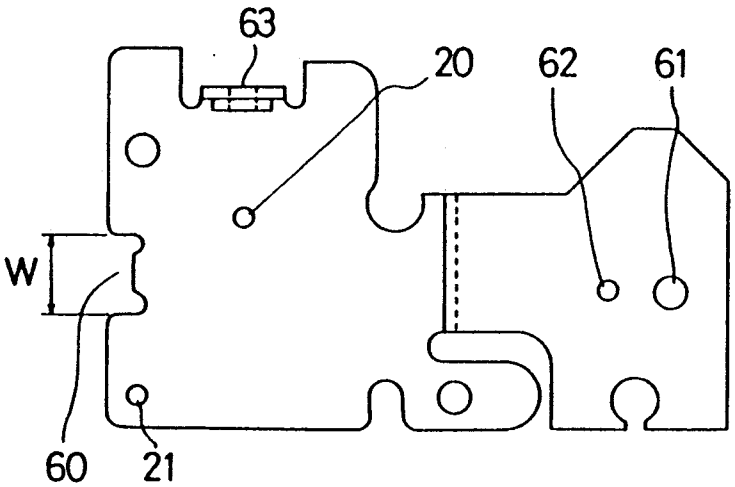
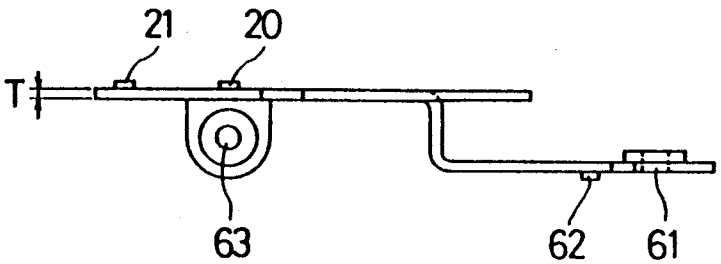
FIG. 9B

17

COMPACT LINE THERMAL PRINTER

BACKGROUND OF THE INVENTION

The present invention relates to line thermal printers, and more specifically relates to those of the compact type corresponding to 60 mm, 80 mm or 112 mm of width size standard of recording paper.

The compact line thermal printer is typically utilized as an output terminal or device of a measurement and analysis instrument, POS data communication branch unit, CRT hard copy machine and medical instrument. The conventional compact line thermal printer is comprised of a printer frame dimensioned to fit to a particular width size standard of recording paper, and the printer frame is assempled with various components such as a platen roller, a thermal head, a motor, a gear train and a head-up lever.

However, various components are individually assembled in the conventional compact line thermal printer. Therefore, not only the assembling procedure is complicated, but also disassembling is quite difficult, thereby causing drawbacks that maintainance of the printer and replacement of components are laborious and time-consuming. Further, the individual components are shaped and dimensioned in registration with the particular width size standard of recording paper, thereby causing drawback that the components are specific to a particular model of the printer and therefore are not suitable in mass production.

SUMMARY OF THE INVENTION

In view of the above noted drawbacks of the prior art, an object of the present invention is to provide an improved compact line thermal printer having structure effective to facilitate assembling and disassembling and effective to enable common use of components as much as possible. In order to achieve the above object, the inventive compact line thermal printer is comprised of a pair of side frames opposed to each other a given interval according to a desired width size standard of recording paper, and a guide frame interposed between the pair of side frames to guide a sheet of recording paper. A platen roller unit is disposed between the pair of side frames such that the platen roller unit is detachably and rotatably supported by the side frames. A thermal head unit is disposed to face the platen roller unit, and the thermal head unit is detachably engaged relative to the pair of side frames. A cover plate is disposed to cover and protect the thermal head unit. This cover plate is engaged with respect to the side frames to switch between opening and closing positions. A drive unit is separably mounted on an outer face of one side frame to drive the platen roller unit.

Preferably, the thermal head unit is mechanically linked to the cover plate such that heating elements of the thermal head unit are exposed when the cover plate is held open. Further, the Pair of side frames have general shape and dimension common to different width size standards of recording paper. Moreover, the drive unit is comprised of a motor, a gear train which transmits a motor torque to the platen roller unit had a motor frame for supporting the motor and the gear train. The motor frame has also a general shape and dimension common to different width size standards of recording paper.

According to the present invention, structural components of the line thermal printer are grouped into several blocks or units such as the platen roller unit, thermal head unit, and drive unit. These units are detachably or separably engaged into the pair of side frames. The side frames and the motor frame of drive unit are shaped and dimensioned commonly to different width size standards of recording paper in the form of general or universal components.

Figure 5:
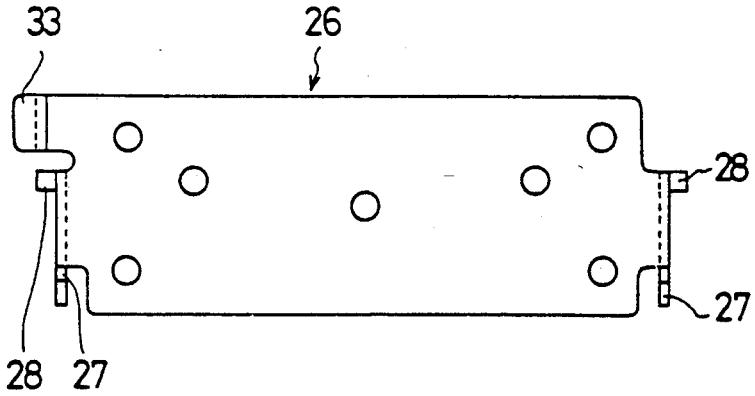
Figure 6:
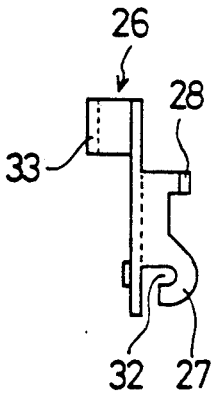
Figure 7:
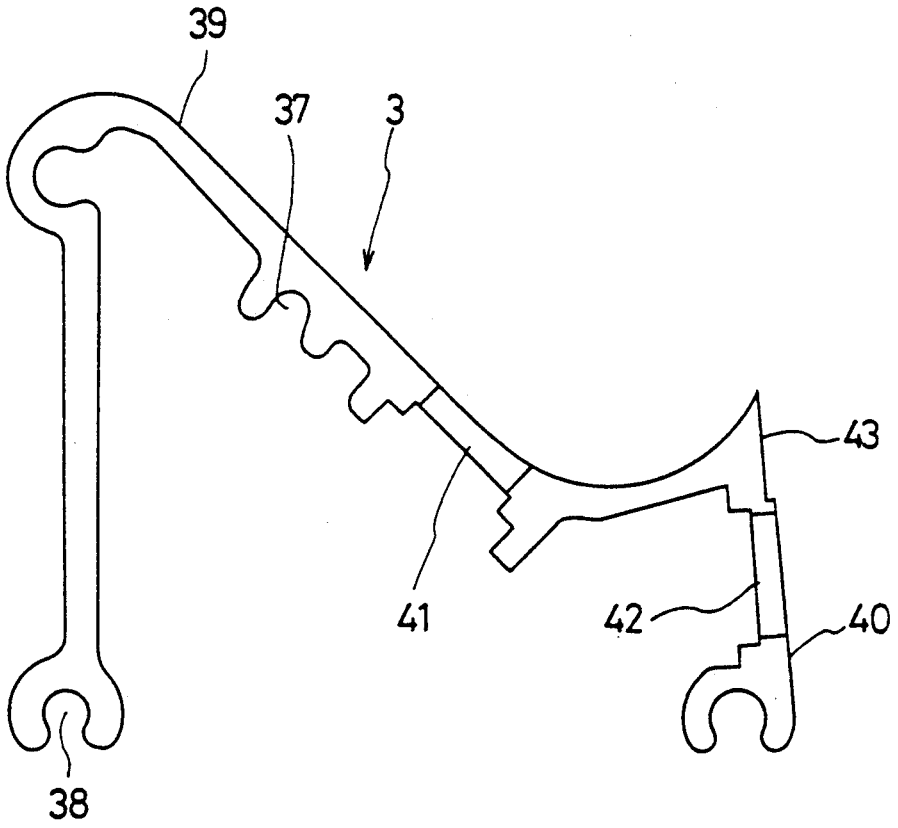
Figure 8:
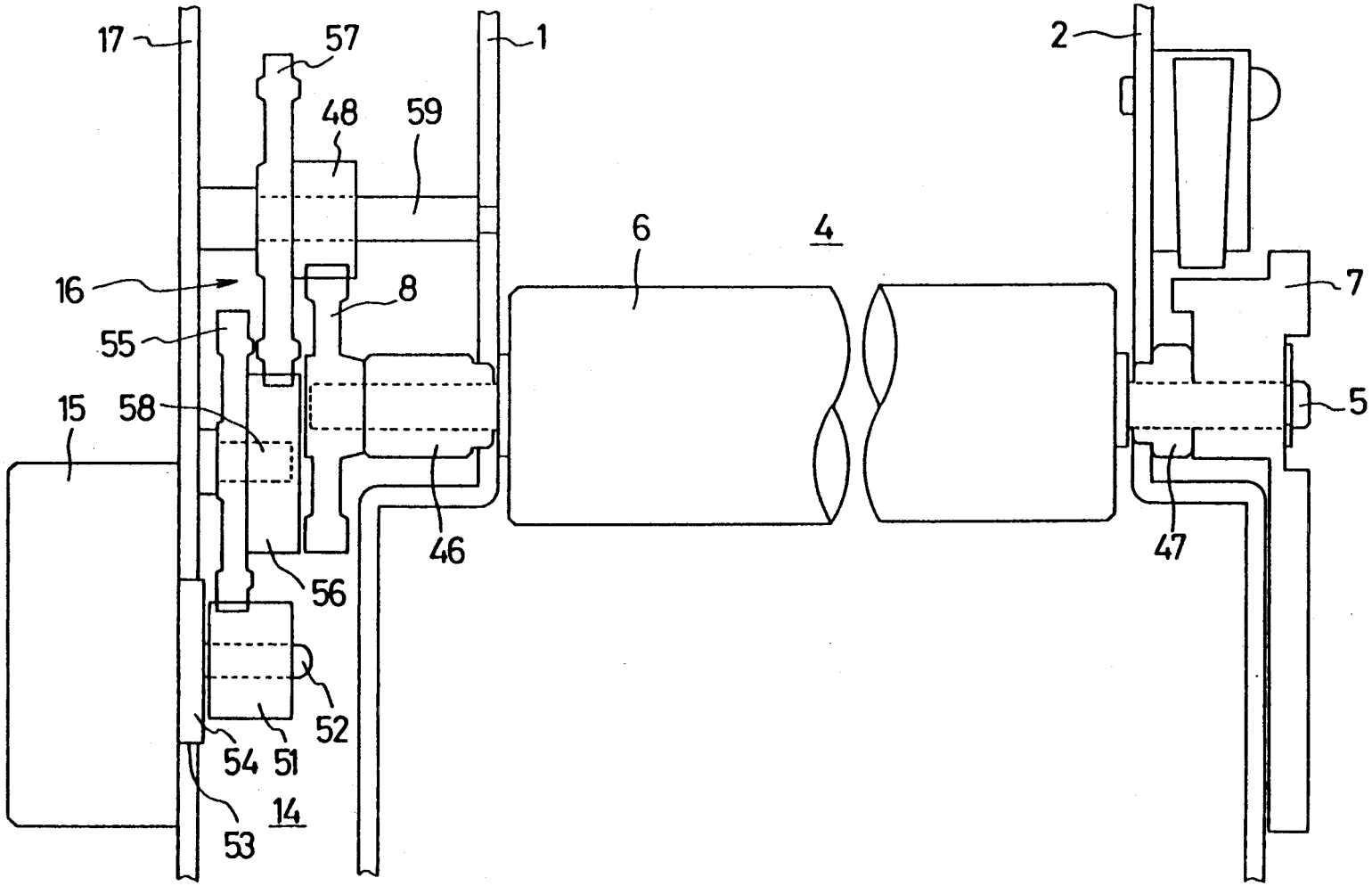
Figure 10C:
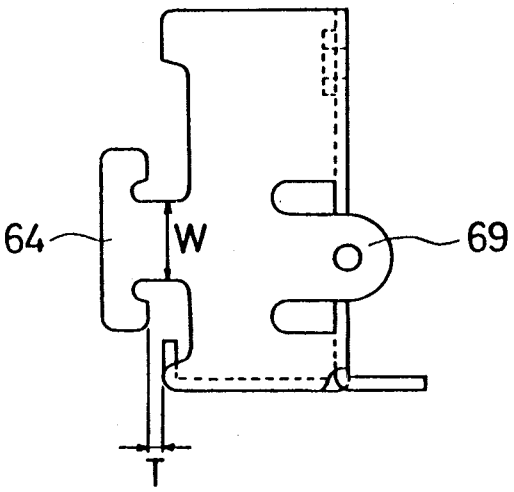
Figure 10A:
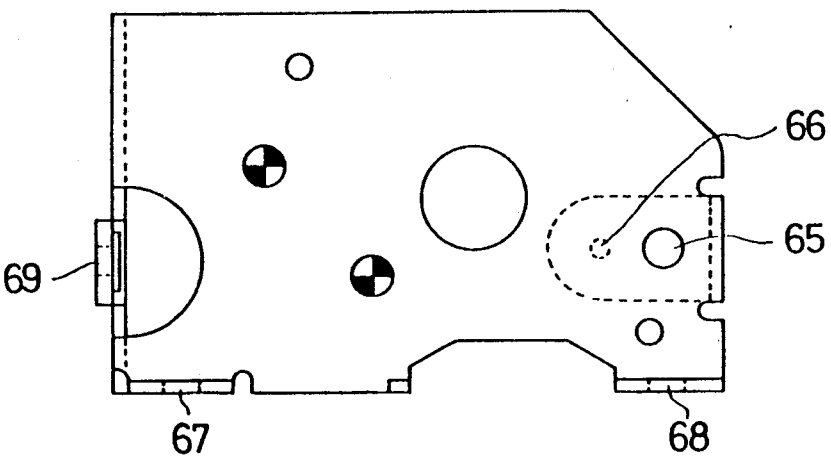
Figure 10B:
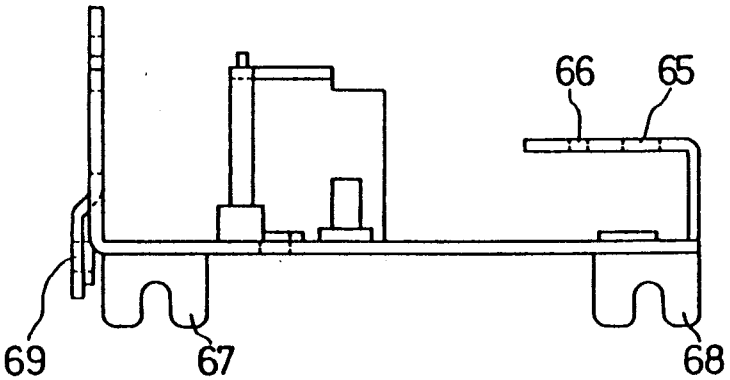
Figure 11:
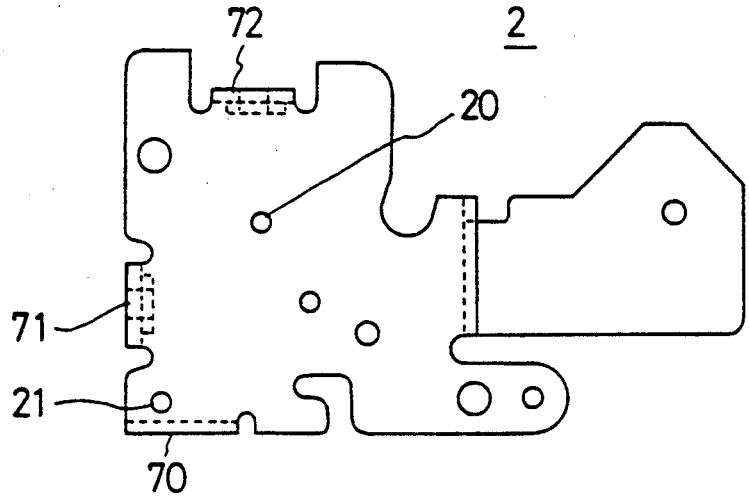
Figure 12A:
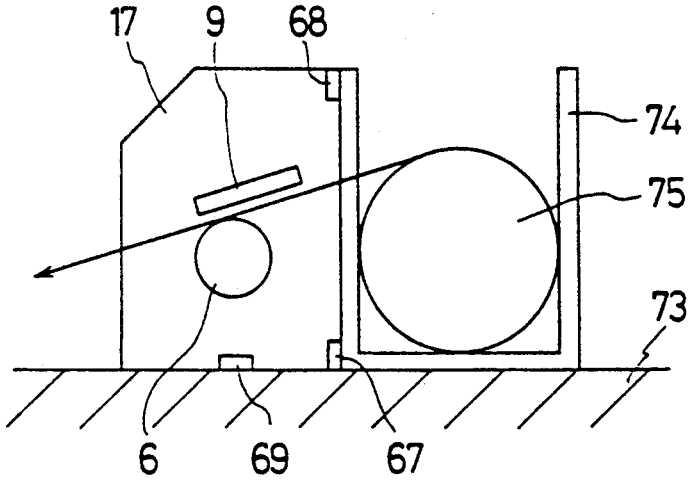

FIG. is a side view of a head cover plate assembled into the line thermal printer;

FIG. 5 is a plan view of a head carrier plate assembled into the line thermal printer;

FIG. 6 is a side view of the same head carrier plate;

FIG. 7 is a side view of a guide frame used in the line thermal printer;

FIG. 8 is a schematic view showing a combination of platen roller unit and drive unit, assembled into the line thermal printer;

FIGS. 9A, 9B and 9C illustrate one side frame of the line thermal printer;

FIGS. 10A, 10B and 10C illustrate a motor frame of the line thermal printer;

FIG. 11 is a front view of the other side frame;

FIG. 12A shows a vertical installation of the line thermal printer; and

Figure 12B:
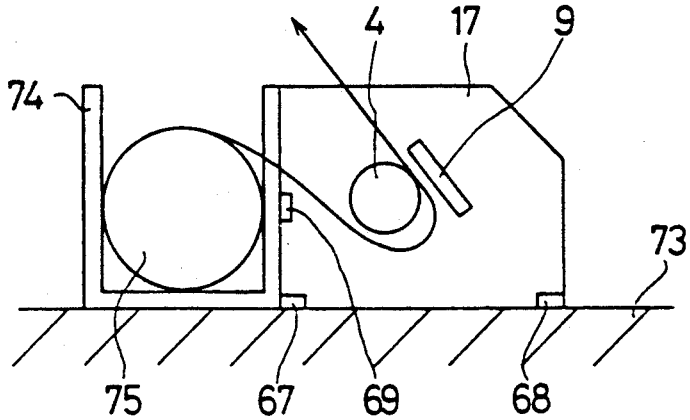

FIG. 12B shows a horizontal installation thereof.

DETAILED DESCRIPTION OF EMBODIMENTS

Figure 1:
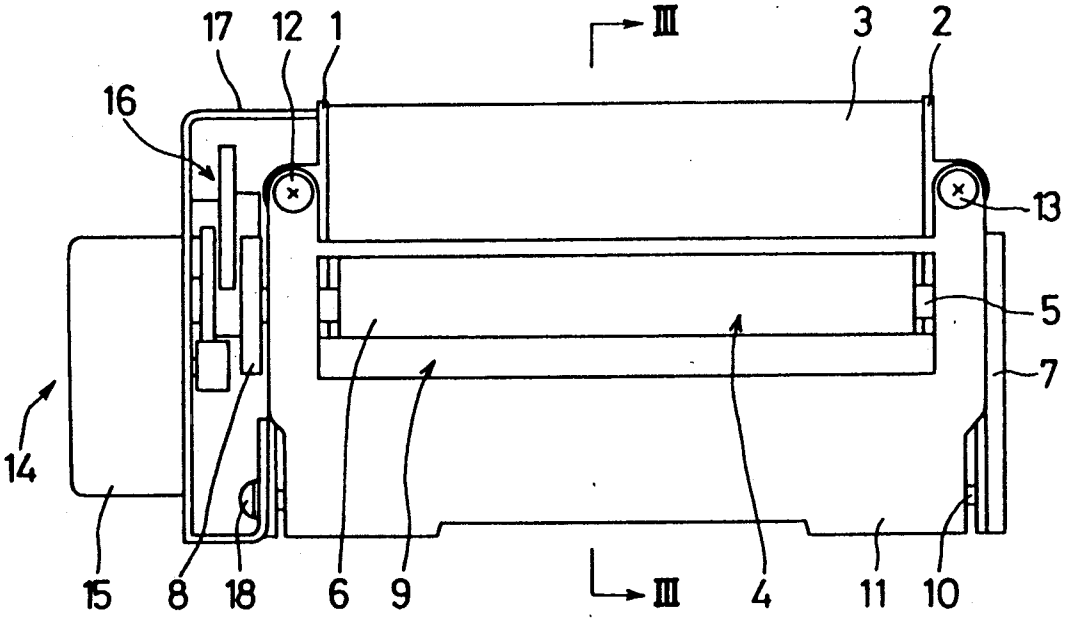
FIG. 1 is a schematic front view of the inventive line thermal printer.

Hereinafter, preferred embodiments of the present invention will be described in detail with reference to the attached drawings. FIG. 1 is a schematic front view of the inventive compact line thermal Printer. The line thermal printer has a pair of side frames 1 and 2 opposed to each other in spaced relation in the width direction of a sheet of recording paper at a given interval or distance in registration with one of the width size standards of recording paper or printing medium such as 60 mm, 80 mm, 112 mm and so on. A guide frame 3 is sandwiched between the pair of side frames 1 and 2 for guiding a recording sheet. The guide frame 3 is composed of an extruded piece which is cut lengthwise in registration with the width size standard of recording paper. A platen roller unit 4 is disposed between the pair of side frames 1 and 2, and is detachably rotatably supported with respect to the side frames 1 and 2. The platen roller unit 4 is comprised of a roller shaft 5, a platen roller 6 formed around the roller shaft 5, a head-up lever 7 attached slidably to one end of the roller shaft 5, and a driving gear wheel 8 fixed to the other end of the roller shaft 5. As shown in the figure, the opposite end portions of the roller shaft 5 are detachably and rotatably supported by the pair of side frames 1 and 2.

A thermal head unit 9 is disposed to face the platen roller unit 4, and is detachably supported with respect to the pair of side frames 1 and 2. In this embodiment, the thermal head unit 9 is detachably engaged to a transverse rod 10 which is fixed at its opposite ends to the pair of side frames 1 and 2. The thermal head unit 9 is pivotable around a pivotal axis in the form of the transverse rod 10 and is biased against the platen roller unit 4. The thermal head unit 9 can be pivoted or angularly displaced between a pressing contact position and a released noncontact position relative to the platen roller unit 4 by manual operation of the head-up lever 7. A cover plate 11 is disposed to cover the thermal head unit 9, and is assembled relative to the side frames 1 and 2 to selectively close and open the printer. In this embodiment, the cover plate 11 is rotatably supported also around a rotational axis defined by the transverse rod 10. In the normal state during use of the printer, the cover plate 11 is firmly closed and fixed by screws 12 and 13 to the side frames 1 and 2. When opening the cover plate 11, the screws 12 and 13 are released and the cover plate 11 is manually rotated in the open direction around the transverse rod 10.

A drive unit 14 is separably attached to an outer face of the side frame 1 so as to rotationally drive the platen roller unit 4. The drive unit 14 is comprised of a motor 15, a gear train 16 for transmitting a drive torque of the motor 15 to the platen roller unit 4, and a motor frame 17 for mounting the motor 15 and the gear train 16. The last gear wheel of the train 16 is detachably engaged with the driving gear wheel 8 which is fixed to the platen roller unit 4 such that the platen roller unit 4 is driven in response to the rotation of the motor 15 to effect feeding of the recording sheet. One side portion of the motor frame 17 is positioned in place and detachably fixed to the side frame 1 and another side portion thereof is fixed to the side frame 1 by a screw 18.

As understood from FIG. 1, the guide frame 3, platen roller unit 4 and thermal head unit 9 are dimensioned lengthwise in accordance with the selected width size standard of the recording paper. On the other hand, the pair of side frames 1 and 2 and the motor frame 17 can be dimensioned and shaped without regard to the selected width size standard of the recording paper because these components are not associated to the selected standard, thereby enabling common use of these components in different models of printer.

Figure 2:
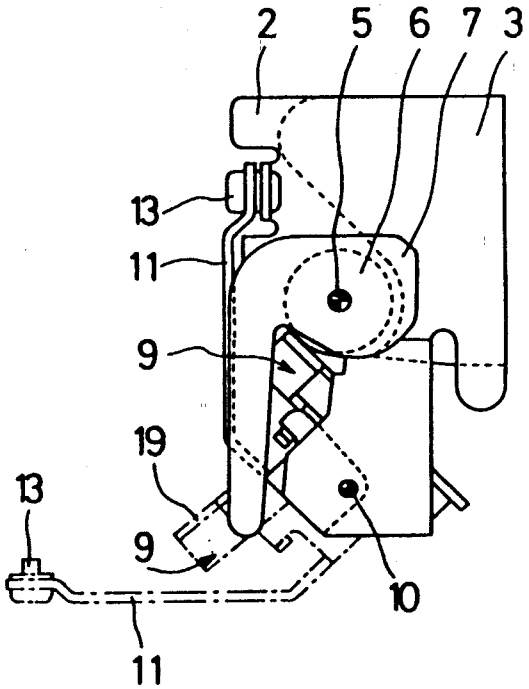
FIG. 2 is a side view of the inventive line thermal printer.

FIG. 2 is a right side view of the invention line thermal printer. As shown in the figure, in the normal operating state, the head-up lever 7 is manually actuated to place the thermal head unit 9 in a pressing contact position to the platen roller 6. The cover plate 11 is closed over the thermal head unit 9 and is fixed to the side frame 2 by the screw 13. On the other hand, in the rest state for maintenance, etc., the screw 13 is removed from the side frame 2 so that the cover plate 11 is rotated counterclockwise around the transverse rod 10 to open the printer as indicated by the dot-and-chain line in FIG. 2. At this sequence, the thermal head unit 9 is mechanically linked to the cover plate 11 so that the thermal head unit 9 is also rotated around the transverse rod 10 in the same direction. Consequently, the thermal head unit 9 is switched from the pressing contact position to an open position such that heating elements 19 of the thermal head unit 9 is exposed for cleaning of a surface of the heating elements 19 to thereby facilitate maintenance work.

Figure 3:
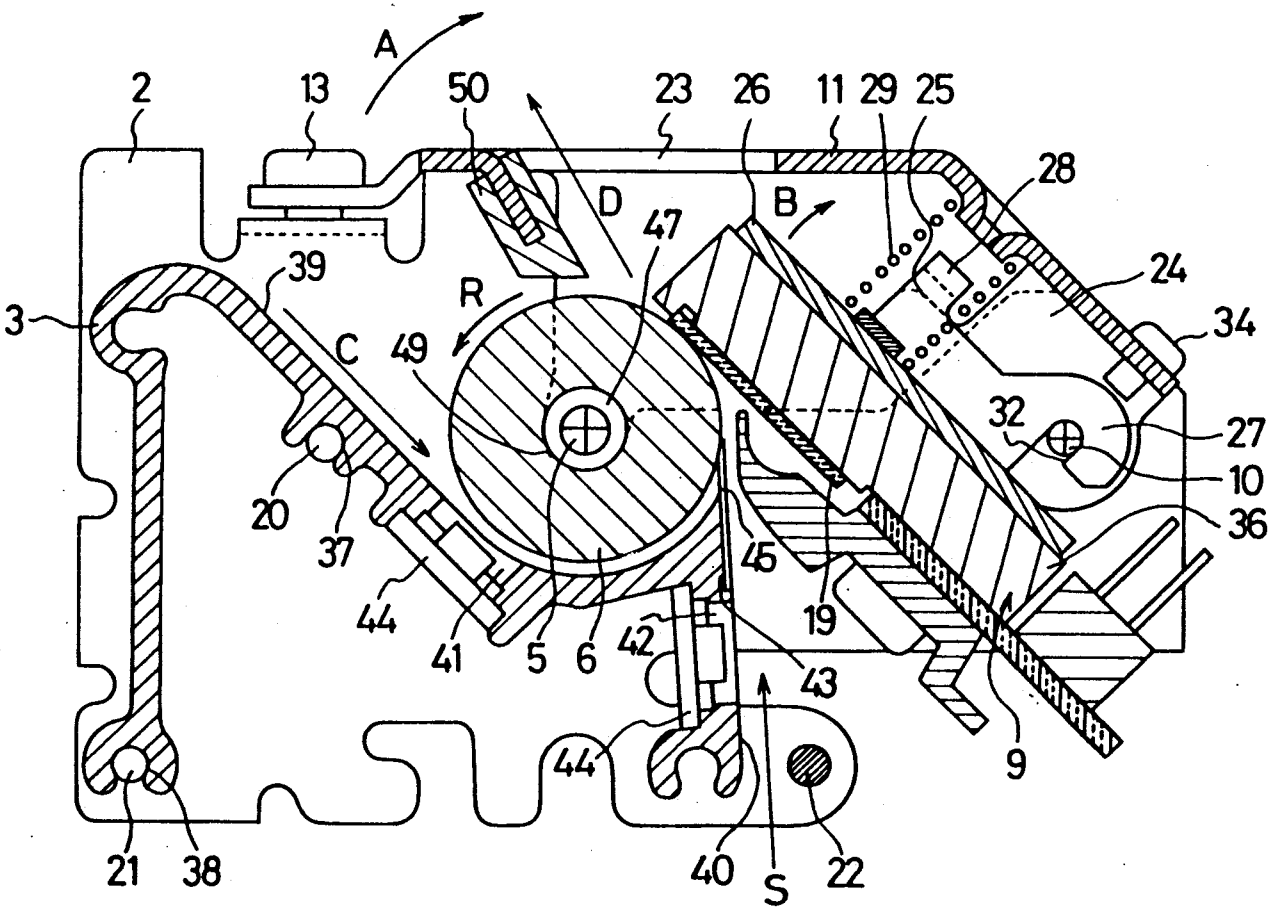
FIG. 3 is a sectional view of the line thermal printer taken along the line A—A indicated in FIG. 1.

FIG. 3 is a sectional view of the inventive line thermal printer, taken along the line A—A of FIG. 1. Overall description is hereinbelow given for construction and assembling of the line thermal printer in conjunction with FIG. 3. As shown in the figure, the side frame 2 has a common outer shape without regard to the selected width size standard of recording paper. A pair of coupling pins 20 and 21 are erectly provided on an inner face of the side frame 2. The guide frame 3 is formed with coupling grooves 37, 38 correspondingly to the coupling pins 20 and 21 so that one end of the guide frame 3 is positioned and fixed to the side frame 2 through the coupling pins and grooves. Although not shown in the figure, the other end of the guide frame 3 is also positioned and fixed to the other side frame 1 in a similar manner. The guide frame 3 defines together with the platen roller 6 a first insert opening receptive of a printing or recording sheet rearwardly of the roller 6 and communicating with a curl path of a recording sheet as indicated by the arrow C. The guide frame 3 also defines a second insert opening forwardly of the platen roller 6 for receiving another recording sheet from a straight path as indicated by the arrow S. A guide rod 22 is arranged between the pair of side frames 1 and 2 at the second insert opening to suppress floating of the inserted recording sheet. Namely, a clearance is provided between a vertical guide face 40 of the guide frame 3 and the guide rod 22 to prevent floating of the recording sheet. Further, the recording sheet is widthwise fixed by the opposed inner faces of the side frames land 2.

A bearing recess portion 49 having a U-shape is formed generally centrally in the side frame 2, and one end portion of the roller shaft 5 is detachably supported in the recess portion 49. The other end portion of the roller shaft 5 is also detachably supported in a corresponding recess portion of the U-shape formed in the other side frame 1 in a similar manner, though not shown in the figure.

The cover plate 11 has an opening 23 communicating with a discharge path of a recording sheet indicated by the arrow D. The cover plate 11 has a folded rim or flange 24 formed with a through-hole for receiving therein the transverse rod 10. By such construction, the cover plate 11 is rotatably engaged around the transverse rod 10. The folded flange 24 is formed at its edge portion with a step portion 25.

The thermal head unit 9 is comprised of a thermal head body 36 and a head carrier plate 26 for detachably assembling the thermal head body. The head carrier plate 26 is also formed with a folded rim or flange 27. The folded flange 27 is formed with a recess portion of U-shape through which the thermal head unit 9 is detachably supported by the transverse rod 10. The folded flange 27 is formed with a protrusion 28 which is engagable with the step portion 25 of the corresponding folded flange 24 of the cover plate 11 so that the thermal head unit 9 is rotationally linked to the cover plate 11. A coil spring 29 is interposed between the cover plate 11 and the head carrier plate 26 to bias or press the thermal head unit 9 against the platen roller 6.

Next, the description is given for the overall operation of the line thermal printer with reference to FIGS. 1-3. Prior to the thermal printing operation, the head-up lever 7 is manually actuated to place the thermal head unit 9 in the released noncontact position relative to the platen roller unit 4. In this state, a recording sheet is selectively fed to the printer through either of the curl path C and straight path S. When the fed recording sheet reaches a gap between the platen roller unit 4 and the thermal head unit 9, the head-up lever 7 is reversely actuated to place the thermal head unit 9 in the pressing contact position relative to the platen roller unit 4 to apply pressure to the recording sheet. In this embodiment, the recording sheet or medium is composed of thermally sensitive paper; however, plain paper may be used in combination with an ink ribbon. Then, the thermal head unit 9 is supplied with a drive electric current and concurrently the platen roller unit 4 is driven so as to effect line printing and paper feeding. The printed sheet is discharged outward through the discharge path D.

In the maintenance and checking, the screws 12 and 13 are removed and the cover plate 11 is rotated around the transverse rod 10 to open the printer. At this time, the thermal head unit 9 is concurrently rotated with the cover plate 9 to thereby expose heating elements 19. In this state, the heating elements 19 are cleaned. Further, the platen roller unit 4 or the thermal head unit 9 may be replaced by a new one if necessary.

As described above, according to the present invention, the line thermal printer is constructed by several divided units so as to facilitate assembling and disassembling as compared to the prior art. A general or common shape and dimension is adopted to components which are not associated with width size standards of the recording paper so as to achieve efficient common use of the components as compared to the prior art. Further, the cover plate is mounted to switch between the open and closed positions cooperatively with the thermal head unit to facilitate maintenance, checking and replacement of components as compared to the prior art.

Figure 4:
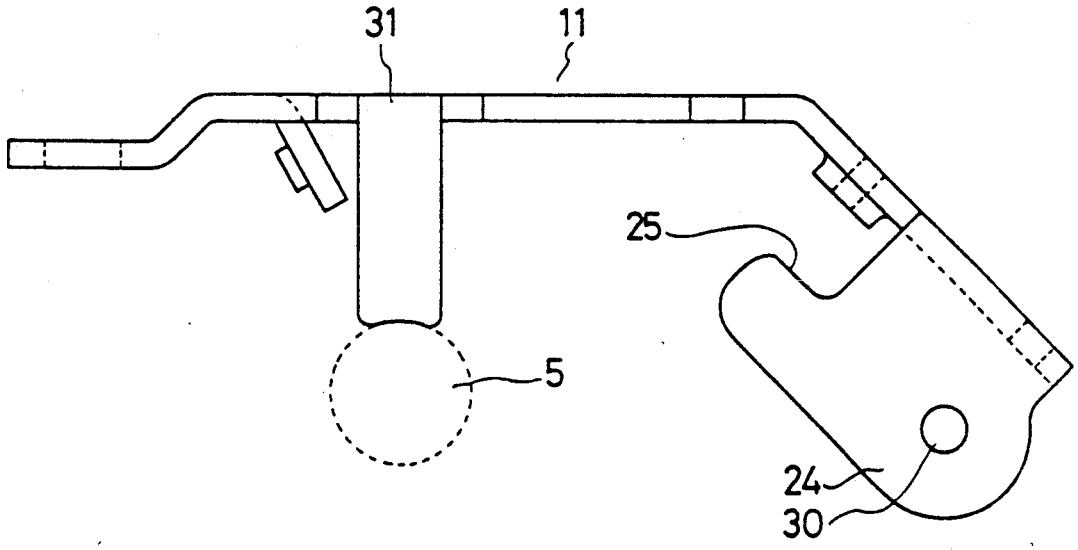

Hereinafter, detailed description is given for various components assembled into the line thermal printer. FIG. 4 is a side view of the Cover plate 11 viewed from the widthwise direction of the recording sheet. As shown in the figure, the cover plate 11 is provided with a pair of folded flanges 24 (though one of them is not shown in the figure) separated from each other in the widthwise direction of the recording sheet. The folded flange 24 is formed with a through-hole 30 into which is inserted one end of the transverse rod 10 (not shown). The head cover plate 11 is rotatably engaged with the transverse rod 10 through the through-hole 30 or axis hole. The cover plate 11 is formed with a folded stopper 31 which abuts on one end of the platen roller shaft 5 when the cover plate 11 is held in the closed position. As described before, the platen roller unit 4 is detachably engaged on the side frames. Therefore, the stopper 31 is provided to prevent disengagement, inclination or floating of the roller shaft 5 which would occur during the driving of the platen roller unit 4 unless otherwise the stopper 31 is provided. The folded flange 24 of the cover plate 11 is formed at its edge portion with a step portion 25 which has a function to cooperatively displace the thermal head unit.

As described before, the thermal head unit 9 is comprised of the head carrier plate 26 which is directly attached to a printer frame unit composed of the pair of side frames and the guide frame, and the thermal head body replaceably mounted on the head carrier plate 26. FIG. 5 is a plan view of the head carrier plate 26, and FIG. 6 is a side view of the head carrier plate 26 viewed from the widthwise direction of the recording sheet. As shown in FIGS. 5 and 6, the head Carrier plate 26 is shaped and dimensioned accurately to match with the frame unit (not shown). The thermal head body (not shown) is replaceably mounted on a surface of the head carrier plate 26 so as to enable replacement of a detective thermal head body to thereby ensure good printing quality. A pair of folded flanges or rims 27 are formed at the opposite ends of the head carrier plate 26 widthwise of the recording sheet. Each of the folded flanges 27 is formed with a recess portion 32 of U-shape. The thermal head unit is detachably and pivotably attached to the transverse rod 10 (not shown). Each of the folded flanges 27 is further provided with a protrusion 28 which is folded vertically relative to the flange 27. This protrusion 28 is positioned to engage with the corresponding step portion 25 of the folding flange 24 of the cover plate 11 so that the thermal head unit 9 is angularly displaced with the displacement of the cover plate 11 in the opening direction. Further, the head carrier Plate 26 is provided at its one end with a stopper 33 which can be made to contact with a cam face of the head-up lever 7 shown in FIGS. 1 and 2. Therefore, the thermal head unit 9 can be pivoted by the head-up lever 7 through the stopper 33 of the head carrier plate 26, while an external mechanical force is not applied directly to the thermal head body.

Returning to FIG. 3, the detailed description is given for the attaching manner and operational movement of the head cover plate 11 and the thermal head unit 9.

The head cover plate 11 is rotatably or pivotably engaged with the transverse rod 10 or frame shaft through the pair of through-holes 30 formed in the respective folded flanges 24. With regard to the thermal head unit 9, its head carrier plate 26 is also detachably and pivotably engaged with the common transverse rod through the pair of U-shaped recess portions 32 formed in the respective flanges 27 of the head carrier plate 26. Further, the protrusion 28 formed on the flange 27 of the head carrier plate 26 is positioned engageably with the step portion 25 formed on the corresponding flange 24 of the cover plate 11 through a given clearance. The head cover plate 11 and the thermal head unit 9 are coupled cooperatively to each other through the engagement between the protrusion 28 and the step portion 25. A plurality of coil springs 29 are arranged widthwise of the recording sheet between the thermal head unit 9 and the cover plate 11 to press the thermal head unit 9 against the platen roller unit 4. The total pressing force of the coil springs 29 is optimumly set according to the selected width size standard of the recording sheet. For example, a number of the coil springs 29 is set proportionally to the width size standard so as to apply a constant pressure to the recording sheet. An adjusting screw 34 is provided through the head cover plate 11 which can be made to contact with a top edge of the flange 27 of the head carrier plate 26. This adjusting screw 34 functions to press the recess portion 32 of the flange 27 against the transverse rod 10. This pressing magnitude is optimumly adjusted so as to avoid the thermal head unit 9 from disengaging relative to the transverse rod 10 as well as to control parallel alignment of the thermal head unit 9 relative to the platen roller unit 4 in the widthwise direction of the recording sheet. Such construction can ensure the close and uniform contact between the platen roller 6 and the thermal head body 36, and can eliminate irregular abutment to remove printing defects such as unclear impression.

When carrying out maintenance or Checking of the line thermal printer or replacement of a component, the screw 13 is released from the side frame 2, and the head cover plate 11 is turned around the transverse rod 10 in the opening direction as indicated by the arrow A. The thermal head unit 9 is concurrently displaced with the movement of the cover plate 11 to rotate around the transverse rod 10 in the same direction as indicated by the arrow B. Consequently, the heating elements 19 along the pressing face of the thermal head body 36 are exposed outwardly to facilitate cleaning treatment. In this open position or state, the platen roller unit 4 may be replaced easily if necessary.

FIG. 7 is a side view of the guide frame 3. The guide frame 3 is composed of an extruded piece. The extrusion is carried out such that metal material held in the plastic state is pressed against a metal mold or die to extrude the metal material. The resulting extruded piece has a given sectional shape corresponding to the die contour in the extruding direction. The guide frame 3 is formed by cutting the elongated extruded piece according to the selected width size standard of the recording sheet. Its sectional shape is common to the different width size standards of recording sheet of, for example, 60 mm, 80 mm or 112 mm.

As shown in FIG. 7, the guide frame 3 is formed with a pair of coupling grooves 37 and 38. Instead of the grooves, other shapes of coupling member may be formed in the guide frame 3 for positioning and coupling thereof to the printer frame unit. The guide frame 3 has a first guide face 39 which defines the curl path of a recording sheet, and a second guide face 40 which defines the straight Path of a recording sheet. A window 41 is formed in the first guide face 39 and another window 42 of the same shape is formed in the second guide face 40. In addition, a cut or step portion 43 is formed on an end portion of the second guide face 40 widthwise of the recording sheet.

Returning to FIG. 3, the detailed description is given for the frame structure of the inventive line thermal Printer. As described before, the pair of coupling pins 20 and 21 are erectly formed on the inside face of the side frame 2. The coupling pins 20 and 21 are positioned in registration with the pair of coupling grooves 37 and 38 formed in the guide frame 3. Therefore, the coupling pins 20 and 21 are respectively coupled to the coupling grooves 37 and 38 to assemble the guide frame 3 between the pair of side frames 1 and 2 to position and fix the guide frame 3 to constitute the printer frame unit or framework.

The first guide face 39 of the guide frame 3 is positioned rearwardly of the platen roller 6 to provide the curl path C, and the second guide face 40 is positioned forwardly of the platen roller 6 to provide the straight path S. A recording sheet is supplied to the platen roller 6 along either of the curl path and straight path, and is then fed by the platen roller 6, and finally is discharged outside through the common discharge path D. The window portion 41 formed in the first guide face 39 has the same dimension and shape as that of the other window portion 42 formed in the second guide face 40. A common detector element 44 is selectively mounted into either of the window portions 41 and 42. Namely, when using the inventive line thermal printer, if the recording sheet is supplied selectively through the curl path C, the detector element 44 is attached to the window 41 to detect passage of the supplied sheet. On the other hand, if the recording sheet is supplied selectively only through the straight path S, the detector element 44 is attached to the window 42.

In any case, the pair of window portions 41 and 42 have the same dimension and shape, and the detector element 44 can be selectively mounted for common use in detection of the passage of paper sheet through the curl path or straight path. The detector element 44 is composed of, for example, a photointerrupter of the reflection type effective to monitor an inadvertent absense of the recording sheet to avoid erroneous operation of the printer. The detector element 44 is comprised of a photosensitive element and a substrate for supporting the photosensitive element. When attaching the detector element 44 to either of the window portions 41-and 42, one edge portion of the detector substrate is placed in abutment with the inside face of the side frame 1 (not shown) to facilitate positioning of the detector element in the widthwise direction of the recording sheet. Namely, the window portions 41 and 42 are spaced a predetermined interval from the inside face of the side wall 1.

A film strip 45 composed of incombustible material is fixed to the step portion 43 formed on an upper section of the second guide face 40. A top free side portion of the film strip 45 is placed in close or light contact with the periphery of the platen roller 6. The film strip 45 is composed, for example, of heat-resistant polyimide plastic and is adhered to the step portion 43 by adhesive or thermal fusion. The film strip 45 is disposed to separate the heating elements 19 of the thermal head body 36 from the first guide face 39. Such arrangement can effectively avoid water vapor generated from the thermo-sensitive recording paper by heating, from forming water drops on the first guide face under the platen roller 6, which would contaminate the thermo-sensitive recording paper. The film strip 45 is fixed to the step portion 43 such as to form a flat face continuous to the second guide face 40 to thereby ensure smooth passage of a recording paper supplied from the straight paths.

As described above, according to the invention, the guide frame is composed of an elongated extruded piece having a common section and is cut in a given length corresponding to a particular width size standard of the recording paper. The guide frame is formed with coupling grooves and each of the side frames are formed on its inside face erectly with coupling pins engageable with the corresponding coupling grooves so that the guide frame and the pair of side frames are positioned and fixed accurately to each other. Moreover, the sectional shape of the guide frame and the outer shape of the side frames are made common to different width sizes of the recording sheets, thereby enabling common use of these components to the different models of printer.

FIG. 8 is a schematic diagram showing the detailed construction of the platen roller unit and the drive unit and assembled state thereof. As shown in the figure, the platen roller unit 4 is comprised of the roller shaft 5, the platen roller 6 formed around the roller shaft 5, the driving gear wheel 8 fixed coaxially to one end of the roller shaft 5, and the head-up lever 7 slideably and coaxially engaged to the other end of the roller shaft 5. The head-up lever 7 is operationally slipped from the roller shaft 5, and is placed in abutment to the thermal head unit (not shown) such that the head-up lever 7 is manualy actuated to place the thermal head unit selectively in either of the pressing contact position and the releasing noncontact position with respect to the platen roller unit 4. A pair of bearing sleeves 46 and 47 ar attached to the opposite ends of the roller shaft 5. The platen roller unit 4 is supported rotatably at the bearing recess portions formed in the respective side frames 1 and 2 through the bearing sleeves 46 and 47. The driving gear wheel 8 fixed to the one end of the roller shaft 5 is engaged to a transmission pinion 48 which is arranged at the last stage of the gear train 16 connected to a rotational shaft 52 of the stepping motor 15. In this manner, the drive unit 14 and the platen roller unit 4 are linked to each other through gear engagement such that the coupling and decoupling is quite easily effected between the drive unit 14 and the platen roller unit 4. The platen roller unit 4 is assembled simply by just placing downward the platen roller unit 4 into the pair of bearing recess portions formed in the side frames 1 and 2. Therefore, in order to avoid removal or release of the platen roller unit 1 from either of the bearing recess portions, the rotational direction of the last transmission pinion 48 is selected such that the transmitted drive torque of the stepping motor 15 acts to press down the platen roller unit 4 into the bearing recess portions through the driving gear wheel 8 which engages with the transmission pinion 48.

Referring back to FIG. 3, detailed description is given for mount structure and operation of the platen roller unit 4. A bearing recess portion 49 having a general U-shape is formed in a substantially central portion of the side frame 2. Although not shown in the figure, a corresponding U-shaped bearing recess portion is formed in a central portion of the other side frame 1. The opposite end portions of the roller shaft 5 are placed downward into the respective bearing recess portions 49 so as to detachably support the platen roller unit 4. Actually, the end portion of the roller shaft 5 is supported in the bearing recess portion 49 through the bearing sleeve 47. The U-shaped bearing recess portion 49 is declined by 0° through 15° relative to the vertical direction so as to facilitate assembling of the platen roller unit 4 and to avoid disengagement thereof after assembling.

The guide frame 3 is disposed under the thus mounted platen roller 6. The guide frame 3 is provide with the first guide face 39 to define the Curl path C to the platen roller 6 and the second guide face 40 to define the straight path S to the platen roller 6. A recording sheet is supplied through either of the curl path C and straight path S, and then is pressed between the platen roller 6 and the thermal head unit 9 to enable line printing, and thereafter is discharged outside through the discharge path D. The platen roller 6 is rotated counterclockwise as indicated by the arrow R in order to discharge the printed sheet. Therefore, the last transmission pinion 48 (not shown in FIG. 3) of the drive unit is rotated clockwise so as to rotate the platen roller 6 counterclockwise. In this embodiment, the transmission pinion 48 is disposed leftward of the platen roller 6 in the figure, so that the drive torque is transmitted through the transmission pinion 48 to the roller shaft 5 such as to press down the same into the bearing recess portion 49 to thereby prevent disengagement or floating of the roller shaft 5. Namely, the direction of the transmitted drive torque is selected toward a bearing bottom edge of the recess portion 49 by suitably setting the position and rotational direction of the transmission pinion.

As described before, the head cover plate 11 is rotatably engaged to the transverse rod 10, and the thermal head unit 9 is also rotatably and detachably hooked to the common transverse rod 10. The cover plate 11 and the thermal head unit 9 are linked to each other such that when the head cover plate 11 is opened, the thermal head unit 9 is accordingly rotated to remove away from the platen roller 6. A safe plate 50 is attached to the head cover plate 11 over the platen roller 6 so as to define the discharge path D. The safe plate 50 is provided to avoid the discharged sheet from being trapped or re-wound by the platen roller 6. The safe plate 50 is removed away from the platen roller 6 when the head cover plate 11 is opened, thereby facilitating replacement of the platen roller 6 in contrast to the prior art structure.

As described above, according to the invention, the platen roller unit is placed or set down into the U-shaped bearing recess portions formed in the respective side frames for rotational support, thereby facilitating assembling of the printer as well as facilitating replacement of the platen roller unit to achieve simple maintenance, checking and replacement. Further, the rotational direction of the gear train of the drive unit is advantageously set such that the drive torque transmitted to the platen roller acts to press down the platen roller to thereby suppress floating of the platen roller. Moreover, the head cover plate and the thermal head unit are opened cooperatively with each other to move away from the platen roller, thereby facilitating replacement of the platen roller unit.

Again returning to FIG. 8, detailed description is given for the drive unit cooperative with the platen roller unit to feed stepwise a recording sheet in the lengthwise direction thereof. As described before, the recording sheet feeding mechanism is comprised of the platen roller unit 4 and the drive unit 14. The platen roller unit 4 is composed of the roller shaft 5, the platen roller 6 formed around the roller shaft 5, the driving gear wheel 8 fixed coaxially to one end of the roller shaft 5, and the head-up lever 7 coaxially and slideably engaged at the other end of the roller shaft 5. The platen roller unit 4 is rotationally supported by the pair of opposed side frames 1 and 2 through the bearing sleeves 46 and 47. In this embodiment, the platen roller 6 has a fixed or common effective outer diameter $\phi D$ of 14.324 mm.

Next, the drive unit 14 is comprised of the stepping motor 15, an actuating pinion 51 fixed to a rotational shaft 52 of the stepping motor 15, the transmission gear train 16 for transmitting the stepwise rotation of the motor 15 reductively to the driving gear wheel 8, and the motor frame 17 for mounting these components. In this embodiment, the stepping motor 15 has a step angle $\theta m$ of 15° so as to undergo stepwise rotation through the set step angle $\theta m$ of 15°.

The motor frame 17 is formed with a positioning opening 53 and the stepping motor 15 is provided with a bearing ring 54 having a given outer diameter in registration with an inner diameter of the positioning opening 53. The bearing ring 54 is filled into the positioning opening 53 to position the stepping motor 15 in place. Further, the actuating pinion 51 fixed to the rotational shaft 52 of the stepping motor 15 has a given outer diameter set smaller than the inner diameter of the positioning opening 53. By such construction, the actuating pinion 51 can be inserted into the positioning opening 53 to thereby facilitate mounting of the stepping motor 15 onto the motor frame 17.

The transmission gear train 16 includes a first gear wheel 55 directly connected to the actuating pinion 51, a second gear wheel 56 coaxially fixed to the first gear wheel 55, a third gear wheel 57 directly coupled to the second gear wheel 56, and a fourth gear wheel in the form of the last transmission pinion 48 which is coaxially fixed to the third gear wheel 57 and is engaged with the driving gear wheel 8. In this embodiment, the gear ratio of the second wheel 56 and the third wheel 57 is selected to determine a particular reduction ratio Gr of the transmission gear train 16. Namely, the stepwise rotational movement of the stepping motor 15 through the constant stepping angle $\theta m$ is . transmitted to the platen roller at the particular reduction ratio to obtain a desired line-sequential feeding pitch P of the recording sheet in the lengthwise direction thereof.

The motor frame 17 is formed on its inner face with a vertical shaft pin 58 for replaceably supporting the coaxial wheels 55 and 56 and another vertical shaft pin 59 for replaceably supporting the coaxial wheels 57 and 48. According to the invention, the pair of shaft pins 58 and 59 are positioned a given distance from each other, and a set of coaxial wheels having different gear numbers can be simply replaced to adjust the gear ratio of the transmission gear train. Accordingly, the motor frame 17 can be commonly used for different models of the printer having different print dot densities in the feeding direction of the recording sheet.

In this embodiment, the print dot density can be set in the feeding direction of the recording paper selectively at one of 6 dots, 8 dots, 12 dots and 16 dots per 1 mm.

This selection is effected by simply changing a gear number $Z_2$ of the second wheel 56 and another gear number $Z_3$ of the third wheel 57 to suitably set the actual reduction ratio G'r to thereby determine a desired feeding pitch P which corresponds to the effective outer diameter $\phi D$ of the platen roller, a gear number Zo of the actuating pinion 51, a gear number Z, of the first wheel 55, a gear number $Z_4$ of the fourth wheel 48 and a gear number $Z_5$ of the driving gear wheel 8 which is fixed to the platen roller unit.

The optimum parameters such as gear number are indicated in the following table according to the embodiment;

TABLE

| dot density | paper feeding pitch P | platen diameter $\phi$ D | motor stepping angle $\theta_m$ | calculated reduction ratio $G_r$ | $Z_0$ | $Z_1$ | $Z_2$ | $Z_3$ | $Z_4$ | $Z_5$ | actual reduction ratio $G_{r'}$ | error $\delta$ |
|---|---|---|---|---|---|---|---|---|---|---|---|---|
| 6 dpm | 0.167 mm | 14.324 mm | 15° | 11.25 | 16 | 44 | 30 | 44 | 15 | 42 | 11.293 | 0.4% |
| 8 dpm | 0.125 | ↑ | ↑ | 15.0 | ↑ | ↑ | 25 | 49 | ↑ | ↑ | 15.092 | 0.6% |
| 12 dpm | 0.083 | ↑ | ↑ | 22.5 | ↑ | ↑ | 19 | 55 | ↑ | ↑ | 22.29 | −0.9% |
| 16 dpm | 0.0625 | ↑ | ↑ | 30.0 | ↑ | ↑ | 15 | 59 | ↑ | ↑ | 30.29 | −0.96% |

In the above table, the calculated reduction ratio Gr is obtained according to the following relation 1:

Gr = $\theta$m/platen roller rotation angle corresponding to the paper feeding pitch P $$= \theta m / \left( \begin{matrix} P \times 360 \\ \phi D \times \end{matrix} \right) \quad 1$$

The actual reduction ratio G'r is determined according to the following relation 2:

$$G'r = \frac{Z_1 \times Z_3 \times Z_5}{Z_0 \times Z_2 \times Z_4} \quad 2$$

Further, axial distances between the coupled wheels are determined according to the following relation 3:

$$\frac{Z_0 + Z_1}{2} \cdot M, \quad \frac{Z_2 + Z_3}{2} \cdot M, \quad \frac{Z_4 + Z_5}{2} \cdot M \quad 3$$

where M denotes module of the gear wheels.

In the above listed table, the calculated reduction ratio Gr is obtained according to the relation 1 to indicate an ideal value of the reduction ratio exactly corresponding to a selected print dot density. The actual reduction ratio G'r is determined according to the relation 2, based on the optimumly set integer gear number $Z_{0/-Z5}$ of the respective gear wheels. As shown in the table, an error $\delta$ is less than 10/0 between the actual gear ratio G'r and the calculated gear ratio Gr, and therefore it does not affect the printing quality. The variable gear number $Z_2$ is set to 30 and the other variable gear number $Z_3$ is set to 44 for 6 dpm of the print dot density. The gear number $Z_2$ is set to 25 and the other gear number $Z_3$ is set to 49 for 8 dpm of the print dot density. The gear number $Z_2$ is set to 19 and the other gear number $Z_3$ is set to 55 for 12 dpm of the print dot density. The gear number $Z_2$ is set to 15 and the other gear number $Z_2$ is set to 59 for 16 dpm of the print dot density. In every case, the total gear number $Z_2 + Z_3$ is set to 74. Therefore, as understood from the relation 3, the axial distance is always held constant between the second wheel 56 and the third wheel 57. Consequently, a corresponding distance is also held constant between the shaft pins 58 and 59 erectly provided on the motor frame 17. Therefore, the motor frame 17 can be commonly used for various print dot density standards. As shown in the relation 3, the gear module must be set to determine the mechanical axial distance between coupled wheels. In this embodiment, the module M is optimumly set in the range from 0.2 to 0.5. If the module M is smaller than 0.2, the gear wheels would not have sufficient mechanical strength and accuracy. On the other hand, if the module M is greater than 0.5, the drive unit would have exceedingly great overall dimension and therefore would not be suitable for compact line thermal printer.

As described above, according to the invention, a particular pair of transmission gear wheels are simply selected to adjust the gear ratio therebetween in order to set a desired print dot density, hence the motor frame has a common shape and structure for different standards of the print dot density, thereby enabling common use of the motor frame to improve mass productivity of the printer. Namely, according to the invention, the outer diameter of the platen roller and the gear number of the attached driving gear wheel are set commonly for different print dot density standards, as well as the stepping angle of the motor, the gear number of the attached actuating pinion, and the axial distances between coupled gear wheels, thereby achieving common use of multiple components.

Referring now to FIGS. 9A, 9B and 9C, the detailed description is given for the shape of the side frame 1, where FIG. 9A is a front view, FIG. 9B is a Plan view, and FIG. 9C is a right side view, respectively, of the side frame 1. As shown in these figures, a positioning notch 60 is formed at one vertical edge of the side frame 1. The notch 60 is recessed rectangularly in a particular width dimension W. A thread hole 61 is formed in the other edge side, and a pin 62 is erectly formed adjacently to the thread hole 61. A folded tongue is Provided at an upper edge of the side frame 1, and is formed with a thread hole 63 which is engaged with the screw 12 shown closed state. In addition, the pair of coupling pins 20 and 21 are formed erectly on the major surface of the side frame 1, which are engaged into the corresponding coupling grooves 37 and 38 formed in the guide frame 3 as shown in FIG. 3. The side frame 1 has a particular plate thickness T.

Next, referring to FIGS. 10A, 10B and 10C, the detailed description is given for the shape and structure of the motor frame 17, where FIG. 10A is a front view, FIG. 10B is a plan view and FIG. 10C is a left side view, respectively, of the motor frame 17. As shown in these figures, the motor frame 17 has a hook 64 of T-shape in general. This hook 64 has a wide head and a narrow neck which has a width dimension w substantially corresponding to the rectangular recess width dimension W of the notch 60 formed at the side frame 1. Further, a clearance is formed between the lower end of the head and the side edge of the motor frame 17, and its gap dimension T corresponds substantially to the plate thickness T of the side frame 1. This T-shaped hook 64 is engaged into the corresponding positioning notch 60 formed in the side frame 1 so that the motor frame 17 is accurately positioned relative to the side frame 1 in the vertical and horizontal directions. A pair of openings 65 and 66 are formed in a folded section of the motor frame 17. The opening 66 is engaged with the pin 62 formed erectly on the side frame 1 and the loose opening 65 is registered with the thread hole 61 formed in the side frame 1. Then, as shown in FIG. 1, the single screw 18 is utilized to fix the motor frame 17 to the side frame 1 through the thread hole 61. As described above, according to the invention, the hook 64 of the motor frame 17 is simply engaged with the positioning notch 60 of the side frame 1 to effect accurate positioning, and the single screw 18 is utilized to fix the motor frame 17 to the side frame 1, thereby improving significantly the positioning accuracy and simplifying assembling work.

The motor frame 17 is further formed at its one horizontal edge portion with a pair of fittings 67 and 68 for use in horizontal installation of the printer, and another fitting 69 is formed at its one vertical edge portion for use in vertical installation of the printer.

FIG. 11 is a front view of the other side frame 2. This side frame 2 is opposed in spaced relation to the side frame 1 in the widthwise direction of the recording paper. A U-shaped fitting 70 is formed at one horizontal edge portion of the side frame 2 for use in the horizontal installation of the printer. Another fitting is formed at one vertical edge portion of the side frame 2 for use in the vertical installation of the printer. This fitting 71 is formed with a thread- hole A thread hole 72 is formed at an upper edge portion of the side frame 2 for receiving the screw 13 to fix the head cover plate 11 as shown in FIG. 1. The pair of coupling pins 20 and 21 are erectly formed on the major face of the side frame 2 to engage with the corresponding coupling grooves formed in the guide frame 3.

Lastly, the description is given for the installation structure and attitude of the compact line thermal printer with reference to FIG. 12A which shows the vertical installation of the line thermal printer and with reference to FIG. 12B which shows the horizontal installation of the line thermal printer. These figures are viewed from one side to which is attached the motor frame 17. In the vertical installation, the printer is fixed to a base 73 by means of the fitting 69. In this case, a holder 74 is attached to the printer by means of the remaining fittings 67 and 68 for storing a roll 75 of the printing paper.

In the horizontal installation, the line thermal printer is fixed to the base 73 by means of the fittings 67 and 68. In this case, the remaining fitting 69 is utilized to fix the holder 74 of the recording paper roll 75.

In the vertical installation, the recording paper is passed through the straight path and then is supplied between the platen roller 6 and the thermal head unit 9. In the horizontal installation, the recording paper is passed through the curl path and is then supplied between the platen roller 6 and the thermal head unit 9. As described above, the inventive line thermal printer is provided with the fittings on the motor frame and on the side frame to enable conveniently either of the vertical and horizontal installations. In addition, the free remaining fittings can be utilized for other purposes. For example, a recording paper cutter may be attached to the line thermal printer instead of the recording paper roll holder.

As described above, according to the invention, a positioning portion or notch is formed at on vertical edge of one of the side frames, and a thread hole is formed in the other vertical edge portion of the same side frame. A hook portion is formed at the motor frame of the drive unit. The hook portion is engaged to the positioning notch of the side frame so as to position the motor frame in place. A single screw is utilized to fix the motor frame to the facing side frame through the thread hole, thereby improving the positional accuracy and assembling work of the motor frame relative to the facing side frame.

What is claimed is:

1. A line thermal printer comprising:

a pair of side frames opposed to each other a given distance according to a given width size of a printing medium;

a guide frame sandwiched between the pair of side frames for guiding the printing medium;

a platen roller unit detachable disposed between the pair of side frames and pivotably supported relative to the pair of side frames;

a thermal head unit detachably engaged relative to the pair of side frames in opposed relation to the platen roller unit;

a head cover plate disposed between the pair of side frames to cover the thermal head unit and placeable in either of an open position and a closed position relative to the pair of side frames; and a drive unit detachably mounted on an outer face of one of the side frames for driving the platen roller unit.

2. A line thermal printer according to claim 1; wherein the guide frame has a first guide face defining a curl path of the printing medium at the rearward portion of the platen roller unit, and a second guide face defining a straight path of the printing medium at the forefront portion of the platen roller unit.

3. A line thermal printer according to claim 2; wherein the second guide face of the guide frame has a step portion along a widthwise direction of the printing medium; and a thermo-resistant film strip having one of the longer sides thereof fixed to the step portion and the other of the longer sides thereof disposed in close contact with the platen roller.

4. A line thermal printer according to claim 2; including window portions in the same shape for attaching a common detector element respectively on the first and second guide faces of the guide frame, the common detector element being selectively mounted in either of the window portions.

5. A line thermal printer according to claim 4; wherein the detector element is placed with one of the edges thereof in abutment with an inner face of one of the side frames positioned at the both ends of the guide frame to position the detector element mounted in the window portion.

6. A line thermal printer according to claim 2; wherein the detector element is placed with one of the edges thereof in abutment with an inner face of one of the side frames positioned at the both ends of the guide frame to position the detector element mounted in the window portion.

7. A line thermal printer according to claim 2; including a guide rod disposed between the pair of side frames in the vicinity of the second guide face of the guide frame for preventing the printing medium from floating.

8. A line thermal printer according to claim 1; wherein the guide frame has a lengthwise dimension corresponding to a given width size standard of the printing medium, and has a pair of coupling grooves for positioning the pair of side frames at the both ends.

9. A line thermal printer according to claim 1; wherein the pair of side frames comprise a pair of recess portions for supporting the platen roller unit, a pair of coupling pins positioned by a pair of coupling grooves formed on the guide frame, and a transverse rod defining the pivotal axis of the thermal head unit which opens and closes together with the head cover plate on the same axis; one of the side frames has a positioning notch for positioning a motor frame, and a thread hole for fixing the motor frame with a screw; and the respective side frames have a common dimension and shape for different width sizes of the printing medium.

10. A line thermal printer according to claim 9; wherein the platen roller unit comprises a roller shaft, a platen roller formed around the roller shaft, a pair of bearing sleeves mounted at the opposite end portions of the roller shaft, a driving gear wheel fixed to one end portion of the roller shaft, and a head-up lever slidably engaged to the other end portion of the roller shaft.

11. A line thermal printer according to claim 10; wherein the platen roller unit is detachably and pivotably supported at its widthwise opposite end portions in a pair of bearing recess portions formed on the pair of side frames and is linked to the drive unit attachably and detachably.

12. A line thermal printer according to claim 9; wherein the platen roller unit is mounted to be attached to or detached from the pair of side frames when the thermal head unit which opens and closed with the head cover plate is in the open position.

13. A line thermal printer according to claim 1; wherein the thermal head unit comprises a head carrier plate, a thermal head body, a heating plate and a circuit card; the thermal head body, the heating plate and the circuit card being replaceably mounted on the thermal head unit.

14. A line thermal printer according to claim 13; wherein the thermal head unit has a pivotal axis common to the head cover plate and opens and closes with the head cover plate to press and release the printing medium through spring means provided between the thermal head unit and the head cover plate against the platen roller unit, and is placed to expose outwardly a pressing face including a heating element of the thermal head unit.

15. A line thermal printer according to claim 13; wherein the head carrier plate is provided with a stopper for a head-up lever formed on the platen roller unit and also provided with a pair of folded flanges at the opposite ends in the widthwise direction, the head carrier plate being detachably mounted through the pair of the folded flanges to the transverse rod.

16. A line thermal printer according to claim 13; wherein the head cover plate has means provided in the widthwise direction thereof for preventing a discharged printing medium from being trapped around the rotating platen roller unit.

17. A line thermal printer according to claim 13; wherein the head cover plate is provided with a screw member disposed in the vicinity of the folded flange of the thermal head unit for avoiding disengagement of the thermal head unit from the transverse rod, the screw member being adjustable to ensure the parallel alignment of the thermal head unit relative to the platen roller unit.

18. A line thermal printer according to claim 1; wherein the drive unit comprises a motor, a gear train for transmitting a drive torque from the motor to the platen roller unit, and a motor frame for mounting the motor and the gear train, the motor frame having a common shape and dimension for different width sizes of the printing medium.

19. A line thermal printer according to claim 18; wherein the drive unit is rotated in a particular direction to transmit a driving torque effective to press the platen roller unit against a bearing face of the side frames.

20. A line thermal printer according to claim 18; wherein the motor frame is detachably mounted to one of the side frames through a positioning notch and a thread hole formed in one of the side frames.

21. A line thermal printer according to claim 18; wherein the gear train comprises a plurality of transmission gear wheels having fixed axial positions relative to each other and a variable gear ratio effective to determine a desired feeding pitch of the printing medium.

22. A line thermal printer according to claim 21; wherein the plurality of transmission gear wheels are replaceably supported rotationally by bearing recess portions provided on the motor frame.

23. A line thermal printer according to claim 18; wherein the motor frame has a positioning hole which has an inner diameter corresponding to the outer diameter of a motor bearing, the motor bearing being mounted in the positioning hole to position the motor, and the outer diameter of the transmission wheel fixed to the axis of the motor is smaller than the inner diameter of the positioning hole.

24. A line thermal printer according to claim 18; including vertical fittings formed at one vertical end portion of the motor frame which is mounted on one of the side frames and at one vertical end portion of another side frame which is remote from the motor frame in the widthwise direction of the printing medium for vertical installation of the line thermal printer, and horizontal fittings formed at one horizontal end portion of the respective side frames for horizontal installation of the line thermal printer.

25. A line thermal printer according to claim 1; wherein the platen roller unit comprises a roller shaft, a platen roller formed around the roller shaft, a pair of bearing sleeves mounted at the opposite end portions of the roller shaft, a driving gear wheel fixed to one end portion of the roller shaft, and a head-up lever slidably engaged to the other end portion of the roller shaft.

26. A line thermal printer according to claim 1; wherein the thermal head unit has a pivotal axis common to the head cover plate and opens and closes with the head cover plate to press and release the printing medium through spring means provided between the thermal head unit and the head cover plate against the platen roller unit, and is placed to expose outwardly a pressing face including a heating element of the thermal head unit.

* * * * *